US007326118B2

(12) United States Patent
Shinoda

(10) Patent No.: US 7,326,118 B2
(45) Date of Patent: Feb. 5, 2008

(54) GAMING MACHINE, TRADING CARD AND GAME SYSTEM

(75) Inventor: Tomohiro Shinoda, Tokyo (JP)

(73) Assignee: Aruze Corporation, Tokyo (JP)

( * ) Notice: Subject to any disclaimer, the term of this patent is extended or adjusted under 35 U.S.C. 154(b) by 577 days.

(21) Appl. No.: 10/763,284

(22) Filed: Jan. 26, 2004

(65) Prior Publication Data

US 2004/0152521 A1 Aug. 5, 2004

(30) Foreign Application Priority Data

Jan. 28, 2003 (JP) ..... 2003-019403

(51) Int. Cl.
*A63F 9/24* (2006.01)

(52) U.S. Cl. ..... 463/43; 463/1

(58) Field of Classification Search ..... 463/20, 463/39, 43, 44, 45
See application file for complete search history.

(56) References Cited

U.S. PATENT DOCUMENTS

| | | | | |
|---|---|---|---|---|
| 5,448,280 | A * | 9/1995 | Matsuda et al. | 347/171 |
| 5,534,685 | A * | 7/1996 | Takemoto et al. | 235/487 |
| 6,468,162 | B1 * | 10/2002 | Nakamura | 463/43 |
| 2001/0034257 | A1 * | 10/2001 | Weston et al. | 463/1 |
| 2002/0028710 | A1 * | 3/2002 | Ishihara et al. | 463/44 |
| 2002/0052238 | A1 | 5/2002 | Muroi | |
| 2002/0076511 | A1 * | 6/2002 | Sanada et al. | 428/1.1 |
| 2004/0002387 | A1 * | 1/2004 | Grady | 463/43 |
| 2004/0169086 | A1 * | 9/2004 | Ohta et al. | 235/492 |

FOREIGN PATENT DOCUMENTS

| | | |
|---|---|---|
| EP | 1 041 525 | 10/2000 |
| JP | 08-021875 | 1/1996 |
| JP | 08-080682 | 3/1996 |
| JP | 11-244537 | 9/1999 |
| JP | 3068024 | 2/2000 |
| JP | 2000 155826 | 6/2000 |
| JP | 2000155826 A * | 6/2000 |
| JP | 2002-301264 | 10/2002 |
| JP | 2002-346215 | 12/2002 |
| JP | 2002-346218 | 12/2002 |
| JP | 2002-346229 | 12/2002 |

* cited by examiner

*Primary Examiner*—Ronald Laneau
*Assistant Examiner*—Benjamin W. Lee
(74) *Attorney, Agent, or Firm*—Snider & Associates; Ronald R. Snider

(57) ABSTRACT

A gaming machine uses a trading card 20. The trading card 20 stores character data concerning a character and has a surface printed with a detail of the character data. A trading card handling device 60 writes changed character data into the trading card 20 in response to a change in character data according to a state of proceeding with a game. A printing device 49 prints detail of the changed character data onto the surface of the trading card 20. A heating device 68 is for erasing the detail of the character data printed previously at the time of printing. A player can grasp details of character data stored in the trading card and changes thereof without depending on the gaming machine to read the trading card.

15 Claims, 10 Drawing Sheets

GAMING MACHINE, TRADING CARD AND GAME SYSTEM

RELATED APPLICATIONS

This application claims the priority of Japanese Patent Application No. 2003-19403 filed on Jan. 28, 2003, which is incorporated herein by reference.

Further, this application is related to co-pending U.S. patent application entitled "GAMING MACHINE" filed on Dec. 12, 2003 (referred to as prior Japanese Patent Application No. 2002-362211 filed on Dec. 12, 2002), and entitled "GAMING MACHINE" (referred to as prior Japanese Patent Application No. 2003-19404 filed on Jan. 28, 2003). The co-pending applications including specifications, drawings, and claims are expressly incorporated herein by reference in their entirety.

BACKGROUND OF THE INVENTION

1. Field of the Invention

The present invention relates to a gaming machine for providing a game played by using a trading card storing character data concerning a character, the trading card, and a game system for providing the game played by using the trading card.

2. Description of the Prior Art

Conventionally, trading cards have been those in which athletes, cartoon characters, and the like are depicted and collected by enthusiasts or maniacs. Trading cards with gaming properties to be used in competitive games have recently been provided. The trading cards with gaming properties are not only collected, but also can proceed with games according to various kinds of information described in the cards.

Most recently, gaming machines providing games played by using trading cards storing character data concerning characters appearing in the games have emerged and come into fashion widely.

An example of such a gaming machine is one in which character data stored in trading cards are written variously according to the state of proceeding with games (see, e.g., Japanese Unexamined Patent Publication No. HEI 11-244537). There has also been known a gaming machine which reads character data from trading cards arranged on an arrangement panel of a terminal, and proceeds with games by using the character data (see, e.g., Japanese Unexamined Patent Publication No. 2002-301264).

An example of game trading cards is one having a surface printed with character data such as the figure and capacity value of a character and a pocket formed from a transparent film (see, e.g., Japanese Utility Model Registration No. 3068024).

When character data stored in a trading card is erased and then new data is written therein in the gaming machine disclosed in Japanese Unexamined Patent Publication No. HEI 11-244537 or No. 2002-301264, however, the character data after rewriting cannot be seen independently of the gaming machine. In general, the attraction of trading cards includes showing and exchanging of trading cards between players who collected the cards. Therefore, trading cards from which values cannot be grasped independently of the gaming machine seem to act only as storage media (so-called memory cards) of character data. Hence, trading cards with gaming properties may disadvantageously lose the original joy of trading cards.

On the other hand, the trading card disclosed in Japanese Utility Model Publication No. 3068024 is one from which character data can be seen independently of gaming machines. However, the character data is stationary and does not change according to the proceeding with games. Therefore, this card may be poor in gaming properties and enjoyment.

SUMMARY OF THE INVENTION

In view of the problems mentioned above, it is an object of the present invention to allow a player owning a trading card to grasp details and changes of character data stored in the trading card without depending on a gaming machine.

For achieving the foregoing object, the present invention provides a gaming machine for providing a game played with a trading card which stores character data of a character and has a surface printed with a detail of the character data;

the gaming machine comprising:

updating means for writing changed character data in the trading card in response to a change in the character data according to a state of proceeding with the game; and printing means for printing a detail of the changed character data onto the surface of the trading card.

Preferably, the gaming machine further comprises erasing means for erasing the detail of the character data printed previously when the printing means prints the detail of the changed character data onto the surface of the trading card.

Preferably, when printing the detail of the changed character data onto the surface of the trading card, the printing means is utilized so as to add the detail of the changed character data to the detail of the character data printed previously.

Preferably, the gaming machine further comprises a trading card moving device having a slot which inserts and discharges the trading card, the trading card moving device moving the trading card inserted in the slot into the gaming machine.

Preferably, a plurality of gaming machines is arranged in parallel, wherein at least one of the gaming machines comprises:

updating means for writing changed character data in a trading card in response to a change in the character data according to a state of proceeding with a game; and printing means for printing a detail of the changed character data onto the surface of the trading card.

The present invention provides a trading card for a gaming machine;

the trading card storing character data of a character and having a surface printed with a detail of the character data;

wherein the detail of the character data is printable a plurality of times.

The present invention provides a trading card for a gaming machine;

the trading card storing character data of a character and having a surface printed with a detail of the character data;

wherein the detail of the character data is repeatedly erasable and printable.

Preferably, a transponder of a radio frequency identification (RFID) system is utilized as the trading card.

Preferably, the detail of the character data printed in the trading card is at least one of a figure of the character, a capacity value of the character, and a number of appearances of the character in the game.

Preferably, the trading card comprises therein an antenna and single chip which allow a radio wave to be transmitted and received, and further comprises a color layer which generates heat upon irradiation with light having a specific wavelength, and a rewritable layer laminated on the color layer and adapted to become transparent or opaque depending on heat.

Preferably, the trading card is configured such that, when heated to a specific temperature, the rewritable layer becomes transparent so that the detail of the character data printed on the surface is erased.

Preferably, the trading card is configured such that, when irradiated with light having a predetermined pattern, the rewritable layer selectively becomes opaque so that the detail of the character data appears on the trading card and is printed.

The present invention provides a game system comprising:

a trading card which stores character data of a character and has a surface printed with a detail of the character data;

game controlling means for proceeding with a game according to the character data stored in the trading card and a control signal from a controller;

updating means for writing changed character data in the trading card in response to a change in the character data according to a state of proceeding with the game; and printing means for printing a detail of the changed character data onto the surface of the trading card.

Preferably, the game system further comprises erasing means for erasing the detail of the character data printed previously when the printing means prints the detail of the changed character data onto the surface of the trading card.

Preferably, the game system is configured such that, when printing the detail of the changed character data onto the surface of the trading card, the printing means is utilized so as to add the detail of the changed character data to the detail of the character data printed previously.

Preferably, the game system further comprises a trading card moving device having a slot which inserts and discharges the trading card, the trading card moving device moving the trading card inserted in the slot into the game system.

Preferably, a plurality of game systems is arranged in parallel, wherein at least one of the game systems comprises:

a trading card which stores character data of a character and has a surface printed with a detail of the character data;

game controlling means for proceeding with a game according to the character data stored in the trading card and a control signal from a controller;

updating means for writing changed character data in the trading card in response to a change in the character data according to a state of proceeding with the game; and printing means for printing a detail of the changed character data onto the surface of the trading card.

BRIEF DESCRIPTION OF THE DRAWINGS

FIG. 4A is a block diagram schematically showing the internal configuration of the main unit of the gaming machine shown in FIG. 1, whereas

FIG. 5A is a perspective view schematically showing the trading card in accordance with an embodiment of the present invention, whereas

DESCRIPTION OF THE PREFERRED EMBODIMENTS

Embodiments of the present invention will now be explained with reference to the drawings.

First, as a preferred embodiment, a case where a gaming machine in accordance with the present invention is employed as an arcade gaming machine will be illustrated and explained.

Figure 1:
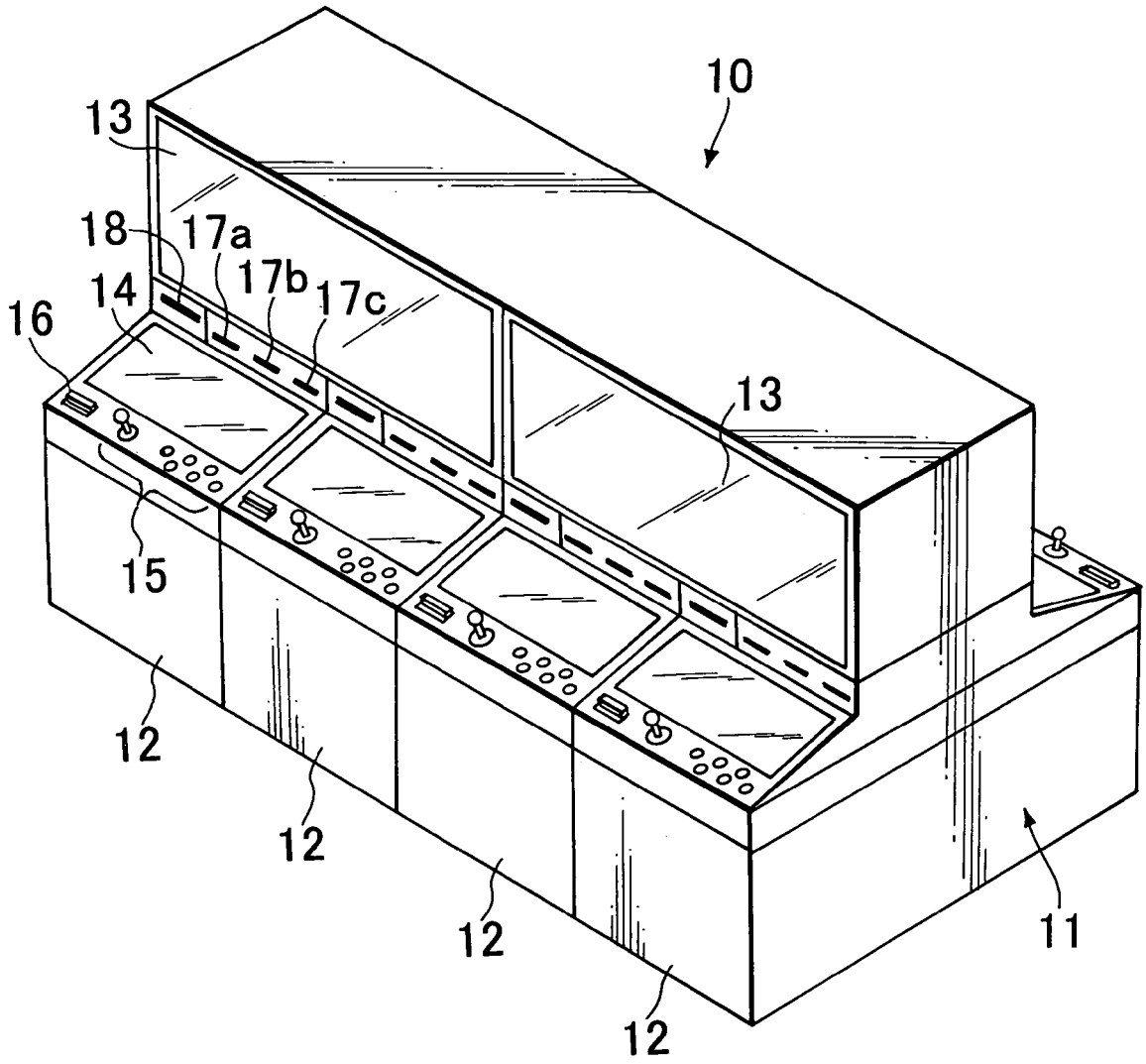
FIG. 1 is a perspective view schematically showing the gaming machine in accordance with an embodiment of the present invention.

FIG. 1 is a perspective view schematically showing the gaming machine in accordance with an embodiment of the present invention.

As a trading card, the gaming machine shown in FIG. 1 employs a rewritable card using a transponder of an RFID (Radio Frequency IDentification) system, in which details of character data written on its surface are repeatedly erasable and printable.

Details of character data written in the rewritable card are not restricted in particular, examples of which include the figure of a character, the capacity value of the character, and the number of appearances of the character in a game.

The gaming machine 10 comprises a main unit 11 composed of eight satellites 12 in total constituted by four arranged on the front side and four arranged on the rear side, whereby at most eight players can play a game simultaneously. Large monitors 13 are vertically disposed between the group of four satellites 12 on the front side and the group of four satellites 12 on the rear side, and display images according to the state of proceeding with the game.

Each satellite 12 has an upper face provided with a monitor 14 for displaying images related to the game, a controller 15 to be operated by a player, and a coin insertion slot 16 for inserting coins required for playing the game. On their back, three TC (trading card) slots 17*a* to 17*c*, and an MC (memory card) insertion slot 18 are provided. Both memory card and trading card are used in the gaming machine 10. However, the memory card stores data concerning game histories of players, and thus differs from the trading card storing character data and data concerning game histories of characters.

Figure 2:
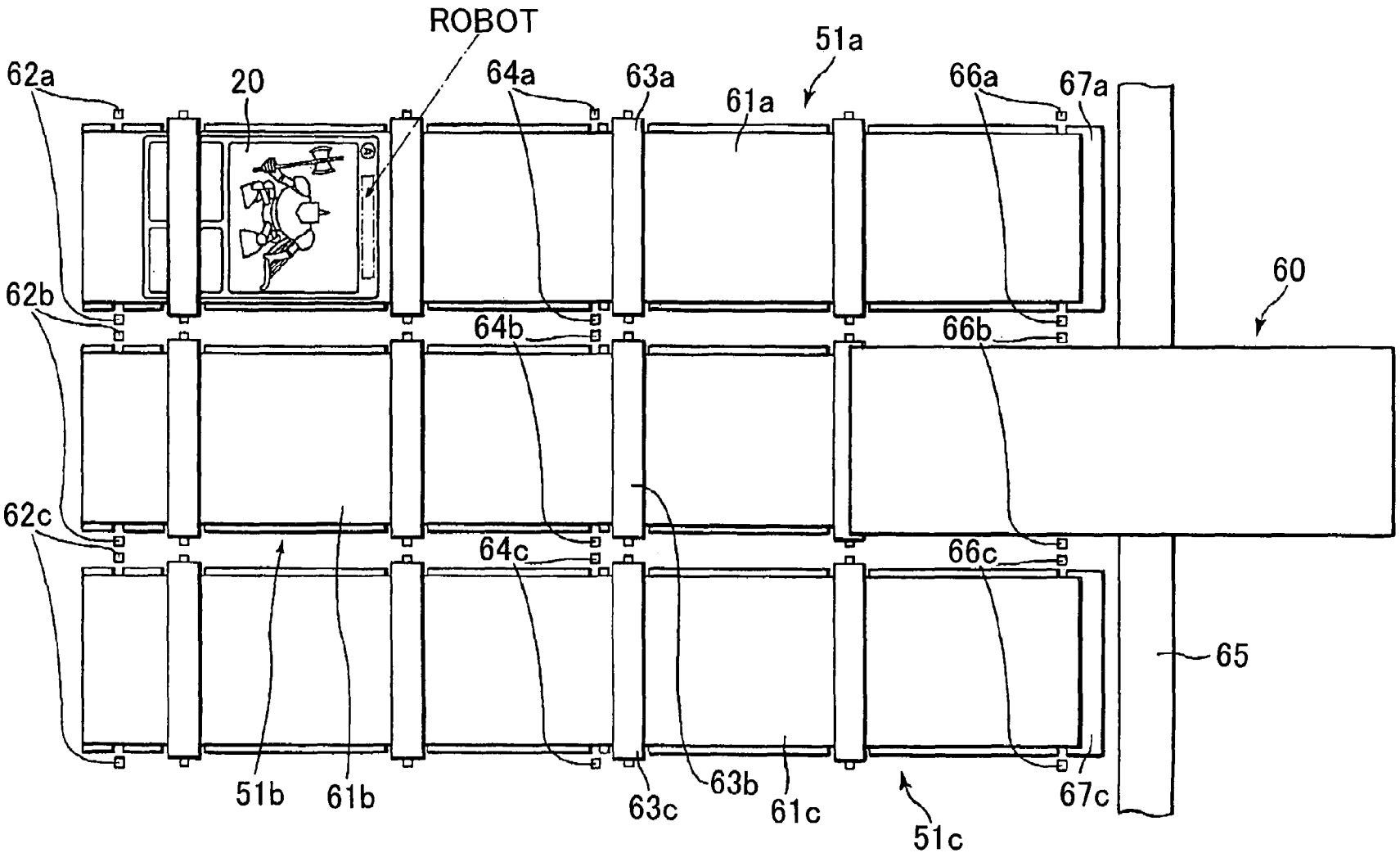
FIG. 2 is a plan view schematically showing a part of the interior of a satellite in the gaming machine shown in FIG. 1.

FIG. 2 is an enlarged plan view schematically showing the vicinity of the TC slot 17 within the satellite 12.

As shown in FIG. 2, TC moving devices 51 (51*a* to 51*c*) for moving trading cards inserted in the TC slots 17*a* to 17*c* formed in the satellite 12, and a TC handling device 60 are placed within the satellite 12.

The TC moving device 51*a* comprises a TC passage trough 61*a* on the inside of which a trading card 20 passes, rollers 63*a* disposed at equally spaced intervals on the TC passage trough 61*a*, and a front sensor 62*a*, a center sensor 64*a*, and a rear sensor 66*a* which are infrared sensors. The rollers 63*a* are used for moving the trading card 20 to the back side on the TC passage trough 61*a*, whereas the front sensor 62*a*, center sensor 64*a*, and rear sensor 66*a* are used for detecting the trading card passing over the TC passage trough 61*a*.

The TC handling device 60 reads character data from the trading card 20, writes character data into the trading card 20, erases details of character data printed on the surface of the trading card 20, and prints details of character data onto the surface of the trading card 20. The TC handling device 60 can move along a rail 65.

The TC handling device 60 will later be explained in detail with reference to drawings.

When the trading card 20 is inserted into the TC slot 17*a*, the trading card is initially detected by the front sensor 62*a*, whereby a motor (not depicted) connected to the rollers 63*a* is driven to rotate the rollers 63*a*, so that the trading card 20 moves to the back side over the TC passage trough 61*a*. When the trading card 20 is detected by the rear sensor 66*a* placed near a stopper 67*a* disposed at the rear end of the TC passage trough 61*a*, the rollers 63*a* stop rotating, whereby the trading card 20 halts on the TC passage trough 61*a* while in a state in contact with the stopper 67*a*.

When the trading card 20 is detected by the center sensor 64*a* while in the process of moving to the back side over the TC passage trough 61*a*, the TC handling device 60 moves to the position where the trading card 20 is stopped. Here, the trading card 20 mounted on the TC passage trough 61*a* is covered with the TC handling device 60. For example, when the trading card 20 is detected by the center sensor 64*a*, the foremost roller 63*a* may be stopped and kept from rotating thereafter even when the front sensor 62*a* detects a trading card, so as to prevent trading cards from being inserted into the TC slot 17*a* in an overlapping fashion.

When the TC handling device 60 stops at a position where the trading card 20 is mounted, character data are read from the trading card 20.

When a game ends, the TC handling device 60 writes the trading card 20 with character data changed according to the proceeding with the game. Further, after details of the character data printed on the surface of the trading card 20 are erased, details of changed character data are printed on the surface of the trading card 20.

In the following explanation, the writing of changed character data and printing of details of changed character data into the trading card will also be referred to as rewriting of the trading card.

After the rewriting of the trading card 20 is completed, the rollers 63*a* rotate in reverse, whereby the trading card 20 moves to the front side, so as to be discharged from the TC slot 17*a*.

The TC moving devices 51*b*, 51*c* are similar to the above-mentioned TC moving device 51*a* in terms of the configuration and the like, and thus will not be explained in detail.

In FIG. 2, 61*b* and 61*c* are TC passage troughs; 63*b* and 63*c* are rollers; 62*b* and 62*c*, 64*b* and 64*c*, and 66*b* and 66*c* are front, center, and rear sensors, respectively; and 67*c* is a stopper.

The process in which the TC moving devices 51*b*, 51*c* move trading cards to predetermined positions, and the TC handling device 60 reads character data and rewrites the trading cards is similar to that in the case of the TC moving device 51*a*.

A method by which the TC handling device shown in FIG. 2 reads character data from a trading card and rewrites the trading card will now be explained with reference to drawings.

Figure 3:
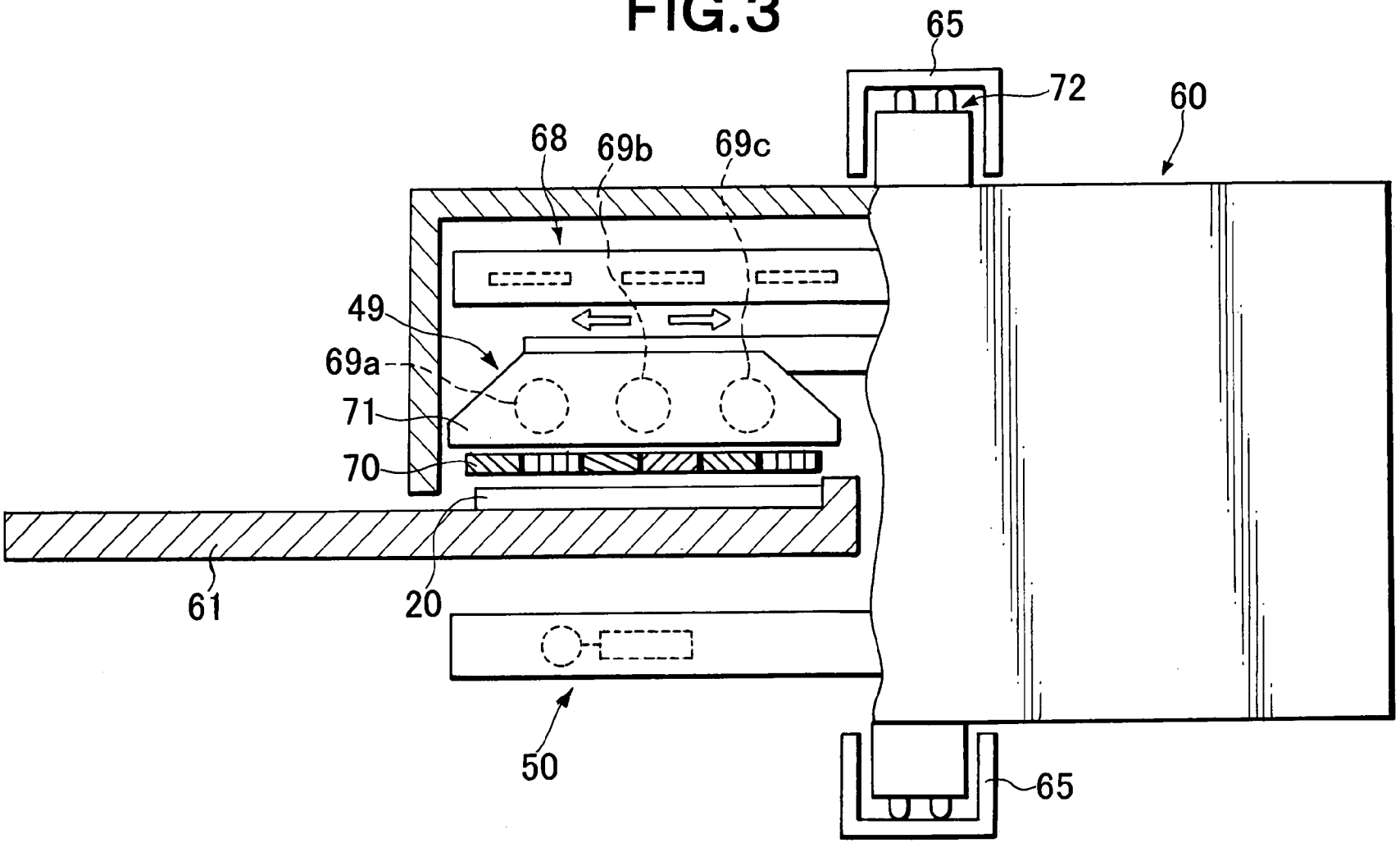
FIG. 3 is a side view schematically showing a TC moving device and TC handling device in the gaming machine shown in FIG. 1.

FIG. 3 is a side view schematically showing how the TC handling device reads character data from a trading card and rewrites the trading card. For convenience of explanation, FIG. 3 shows a state where a part of the TC handling device is fragmented.

As will be explained in detail with reference to FIGS. 5A and 5B, the trading card has the following structure. Namely, the trading card comprises therein an antenna and single chip for allowing a radio wave to be transmitted and received, and further comprises a color layer for generating heat upon irradiation with light having a specific wavelength, and a rewritable layer laminated on the color layer and adapted to become transparent or opaque depending on heat.

Heating the whole surface of the trading card to a specific temperature (e.g., 100° C.) can erase details of character data printed on the surface. On the other hand, irradiating the whole surface of the trading card with light having a predetermined pattern and heating the color layer to a specific temperature (e.g., 70° C. to 95° C.) can print details of character data.

As shown in FIG. 3, the TC handling device 60 comprises a running device 72 for moving along the rail 65.

Above the trading card 20 mounted on the TC passage trough 61 within the TC handling device 60, a printing device 49 for printing details of changed character data onto the trading card 20 is provided. Disposed above the printer 49 is a heating device 68 for erasing details of character data printed on the surface of the trading card 20. As indicated by whitened arrows in the drawing, the heating device 68 can move frontward and rearward.

Disposed under the part of TC passage trough 61 on which the trading card 20 is mounted within the TC handling device 60 is an R/W 50 for reading character data from the trading card 20 and writing character data into the trading card 20.

The R/W 50 comprises a transmitting/receiving circuit, a control circuit, an antenna, and the like, and transmits query radio waves to the trading card 20 and receives character data from the trading card 20 as answer radio waves, thereby reading and writing character data.

The heating device 68 comprises therein a resistance heating member or the like, and heats the trading card 20 to a predetermined temperature (e.g., 100° C.), so as to cause the rewritable layer within the trading card 20 to become transparent, thereby erasing details of character data printed on the trading card 20. When the heating device 68 heats the trading card 20, the printing device 49 is accommodated on the rear side so as to be kept away from under the heating device 68.

The printing device 49 comprises flash lamps 69*a* to 69*c* for emitting red (R), green (G), and blue (B) light components having respective wavelengths different from each other, a reflector 71 for reflecting the light components emitted from the flash lamps 69*a* to 69*c*, and a liquid crystal panel 70 for displaying color images. When the flash lamps 69*a* to 69*c* emit light, the liquid crystal panel 70 selectively transmits the red, green, and blue light components according to a pattern corresponding to details of character data displayed on the liquid crystal panel 70, and irradiates the surface of the trading card 20 with thus transmitted light, so that the rewritable layer within the trading card 20 becomes selectively opaque, whereby the details of character data are printed on the surface of the trading card 20.

The trading card and a mechanism by which details of character data are erased from and printed onto the trading card will be explained later in detail with reference to drawings.

Figure 4A:
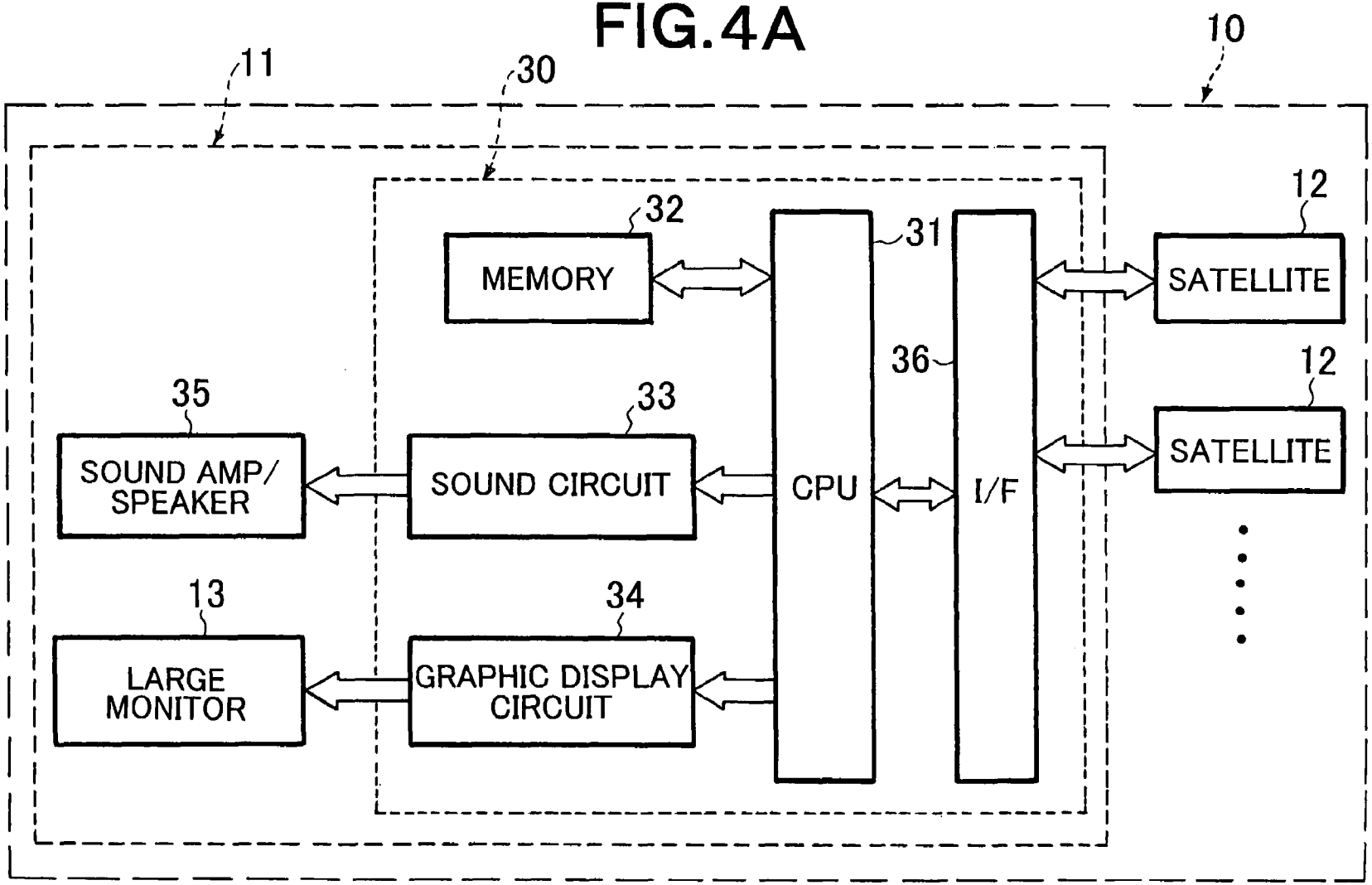
Figure 4B:
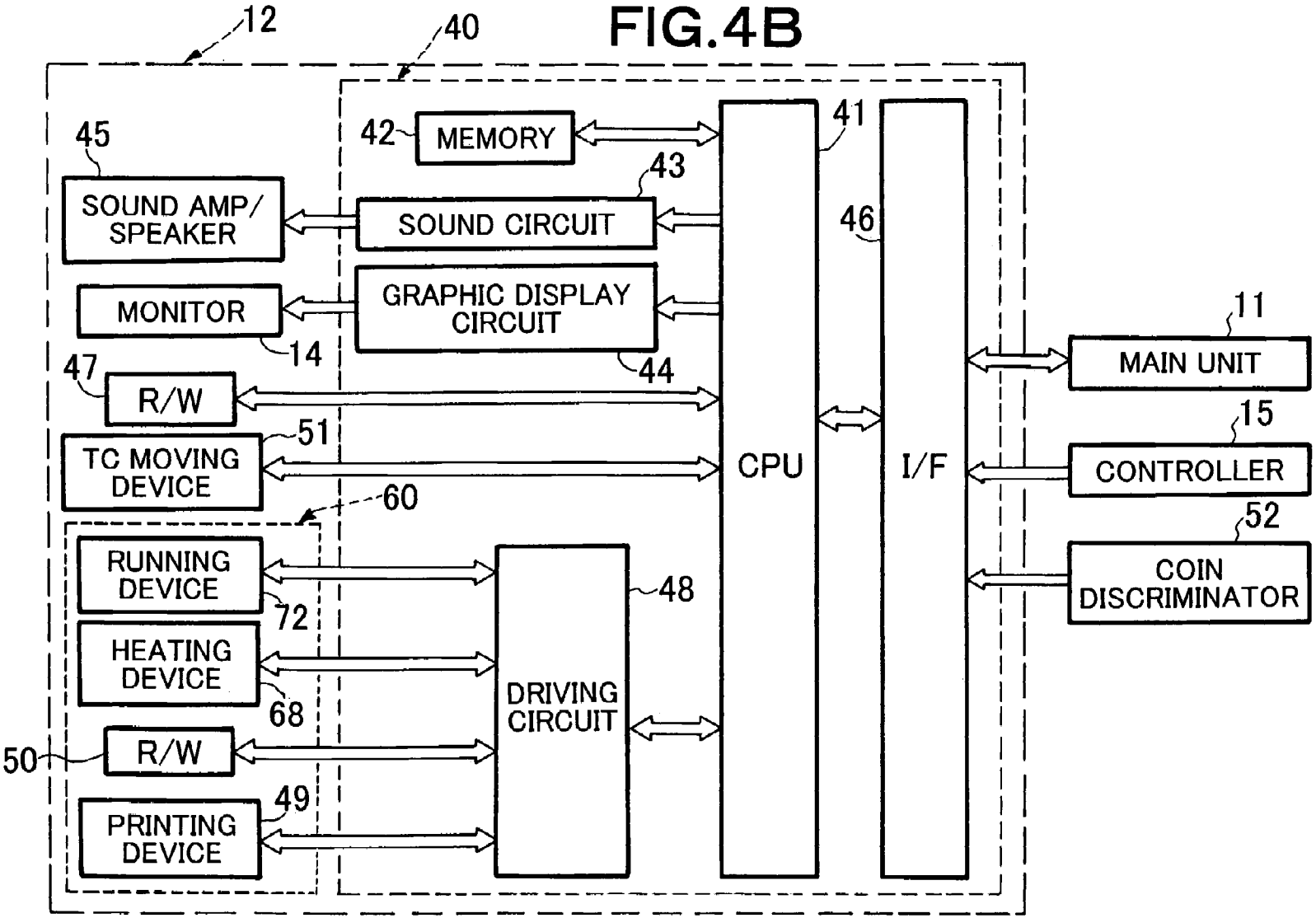
FIG. 4B is a block diagram schematically showing the internal configuration of the satellite of the gaming machine.

FIG. 4A is a block diagram schematically showing the internal configuration of the main unit 11 of the gaming machine 10, whereas FIG. 4B is a block diagram schematically showing the internal configuration of the satellite 12 of the gaming machine 10.

As shown in FIG. 4A, a main controller 30 is provided within the main unit 11 of the gaming machine 10. The main controller 30 comprises a central processing unit (CPU) 31, a memory (RAM) 32, a sound circuit 33, and a graphic display circuit 34. By way of an interface circuit (I/F) 36, the CPU 31 is connected to the eight satellites 12. According to input signals supplied from the satellites 12 by way of the I/F 36 as well as data and programs stored in the RAM 32, the CPU 31 carries out various kinds of processing. Based on results of the processing, the CPU 31 transmits an instruction signal to each satellite 12, so as to regulate the satellite 12 in an initiative fashion, thereby proceeding with the game. Here, the main controller 30 functions as game controlling means.

The memory 32 stores various kinds of image data to be displayed on the large monitor 13, control programs, and the like. The sound circuit 33 is connected to a sound amplifier 35 for outputting sounds corresponding to various images displayed on the large monitor 13. The graphic display circuit 34 causes the large monitor 13 to display an image selected by a control signal from the CPU 31.

As shown in FIG. 4B, a controller 40 is provided within each satellite 12. The controller 40 comprises a CPU 41, a memory 42, a sound circuit 43, a graphic display circuit 44, and a driving circuit 48. By way of an I/F 46, the CPU 41 is connected to the main unit 11 and the controller 15. By way of the I/F 46, the CPU 41 can receive various kinds of data and programs from the main unit 11, and instruction signals supplied when the player operates the controller 15. Also, a coin discriminator 52 is connected to the CPU 41 by way of the I/F 46. When the coin discriminator 52 detects a coin inserted into the coin insertion slot 16, it supplies a detection signal to the CPU 41.

The sound circuit 43 is connected to a sound amplifier 45 for outputting sounds corresponding to various images displayed on the monitor 14. The graphic display circuit 44 causes the monitor 14 to display an image selected by a control signal from the CPU 41.

An R/W 47 is connected to the CPU 41, and reads data from a memory card inserted into the MC insertion slot 18 and writes data into the memory card.

The TC moving device 51 is connected to the CPU 41. As mentioned above, according to control signals from the CPU 41, the TC moving device 51 moves the trading card fed into the satellite 12 to a predetermined position, and moves the rewritten trading card to the TC slot 17, so that the trading card is discharged from the TC slot 17.

By way of the driving circuit 48, the TC handling device 60 is connected to the CPU 41. As mentioned above, the TC handling device 60 comprises the running device 72, heating device 68, R/W 50, and printing device 49. According to control signals from the CPU 41, the TC handling device 60 moves to a predetermined position, reads character data from the trading card, and rewrites the trading card.

The trading card used in the gaming machine 10 will now be explained.

Figure 5A:
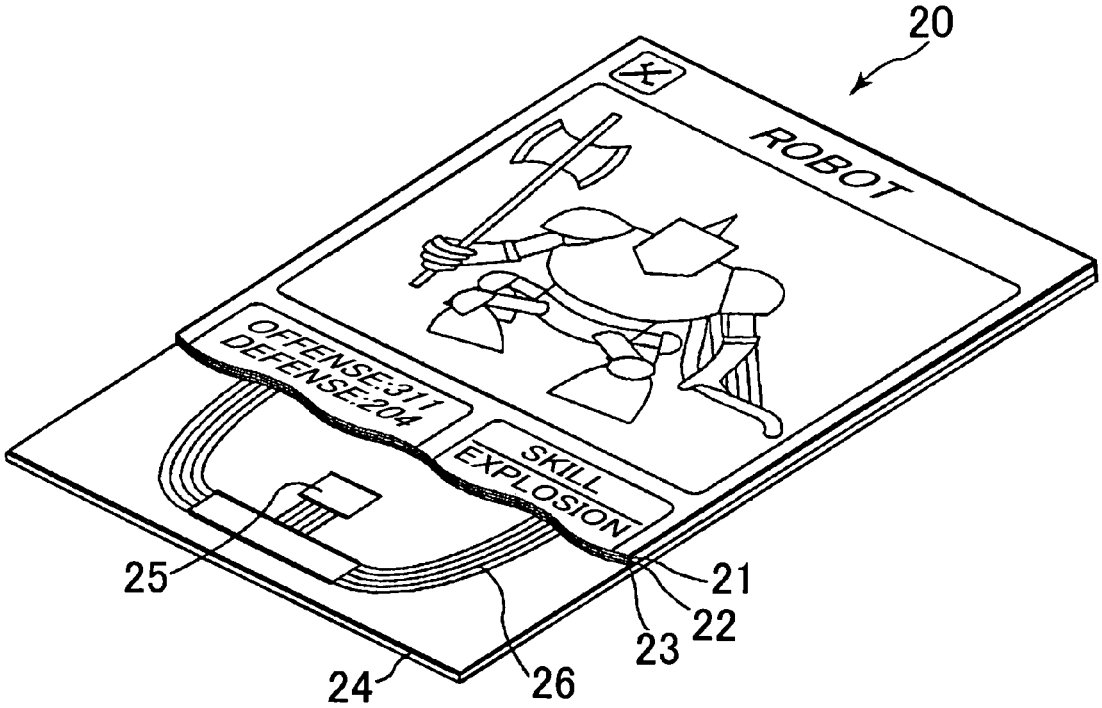
Figure 5B:
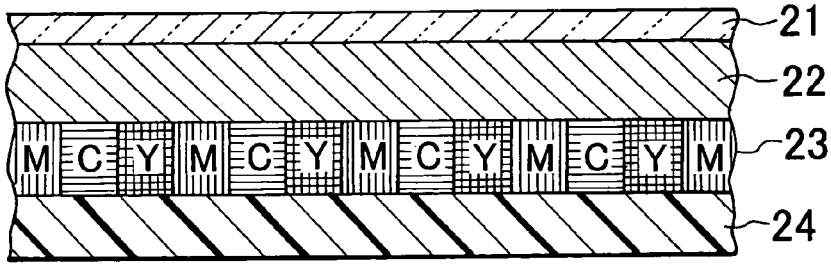
FIG. 5B is a sectional view enlarging a part thereof.

FIG. 5A is a perspective view schematically showing the trading card in accordance with an embodiment of the present invention, whereas FIG. 5B is a sectional view enlarging a part thereof. For convenience of explanation, FIG. 5A shows a state where a part of the trading card is fragmented.

As shown in FIG. 5A, the trading card 20 comprises a rectangular base 24 having an upper face on which a color layer 23, a rewritable layer 22, and a transparent protective layer 21 are laminated in this order. Between the color layer 23 and base 24, a single chip 25 is buried, and an antenna 26 for transmitting and receiving radio waves is printed. The single chip 25 comprises a transmitting/receiving circuit, a control circuit, and a memory. The single chip 25 receives from the antenna 26 an instruction signal emitted from the R/W 50, so as to generate a power, thereby erasing character data stored in the memory and newly writing character data therein; receives query radio waves from the R/W 50; and transmits character data as answer radio waves.

As shown in FIG. 5B, the color layer 23 comprises a number of minute dots of magenta (M), cyan (C), and yellow (Y), whereas the rewritable layer 22 reversibly becomes transparent or opaque when heated to a specific temperature. When the printing device 49 heats the whole surface of the trading card to a specific temperature, the whole surface of the rewritable layer 22 becomes transparent, whereby the whole surface of the trading card becomes black which is a mixed color of magenta, cyan, and yellow. This can erase details of character data printed on the surface of the trading card. When irradiated with light having a pattern corresponding to details of character data by the printing device 49, on the other hand, the rewritable layer 22 selectively becomes opaque, whereby the details of character data appear on the surface of the trading card. This can print the details of character data onto the surface of the trading card.

The rewritable card and the printing and erasing processes concerning the rewritable card are conventionally known techniques, which are described in detail in Japanese Unexamined Patent Publication No. HEI 8-80682, and thus will not be explained here.

The transponder of the RFID system and the data reading and writing processes concerning the transponder are also conventionally known techniques, which are described in Japanese Unexamined Patent Publication No. HEI 8-21875, and thus will not be explained here.

The method of reading and writing character data with respect to the trading card of the present invention can use not only a noncontact type IC card as mentioned above, but also a contact type IC card, for example.

The method of repeatedly erasing and printing details of character data with respect to the trading card of the present invention is not limited to the one mentioned above, but may be one using a toner which loses its color when irradiated with ultraviolet rays, or one which physically or chemically peels off only the toner printed on the trading card, for example.

A method in which a game is carried out by the gaming machine 10, and details of the game provided by the gaming machine 10 will now be explained.

(A) Procedure Before Starting Game

First, a player is required to obtain a memory card before starting the game. The method of providing the player with the memory card is not limited in particular. For example, the memory card may be sold at a counter of an arcade, or issued from the gaming machine 10 in response to a predetermined coin inserted therein. Medals, tokens, and the like can also be used in place of the coin. An example of the memory card is a card equipped with a semiconductor memory such as flash memory, which stores a game history (e.g., a capacity value of a main character operated by the player). The game can be stopped and resumed by using the memory card. By inserting a predetermined coin into the coin insertion slot 16 and the memory card into the MC insertion slot 18, the player can start the game.

(B) Outline of Game

The game provided by the gaming machine 10 is one in which, when trading cards are inserted into the TC slots 17 provided in the satellite 12, characters appear in a virtual world spread in the game, and a main character operated by the player goes through an adventure together with the other characters in order to collect small medals dispersed in the virtual world. Since the satellite 12 is provided with three TC slots 17, the main character can venture with three other characters at the same time. These characters have respective figures, capacity values, and the like based on character data read by the TC handling device 60 from their corresponding trading cards taken into the TC slots 17.

The small medals can be obtained when winning battles against monsters living in the virtual world or other players. When thus collected medals are brought to a predetermined location in the virtual world, characters corresponding to the kind and number of medals can be acquired, and trading cards storing character data concerning these characters are issued from the TC slots 17. When a large number of medals or rare medals are brought there, for example, trading cards of characters having a high capacity value are issued. As a result, the main character can go through an adventure with stronger characters, so that the game can proceed advantageously, whereby trading cards of characters having a higher capacity value or rare trading cards can be collected.

A character data reading process carried out for reading character data from the trading card inserted in the TC slots 17 will now be explained.

Figure 6:
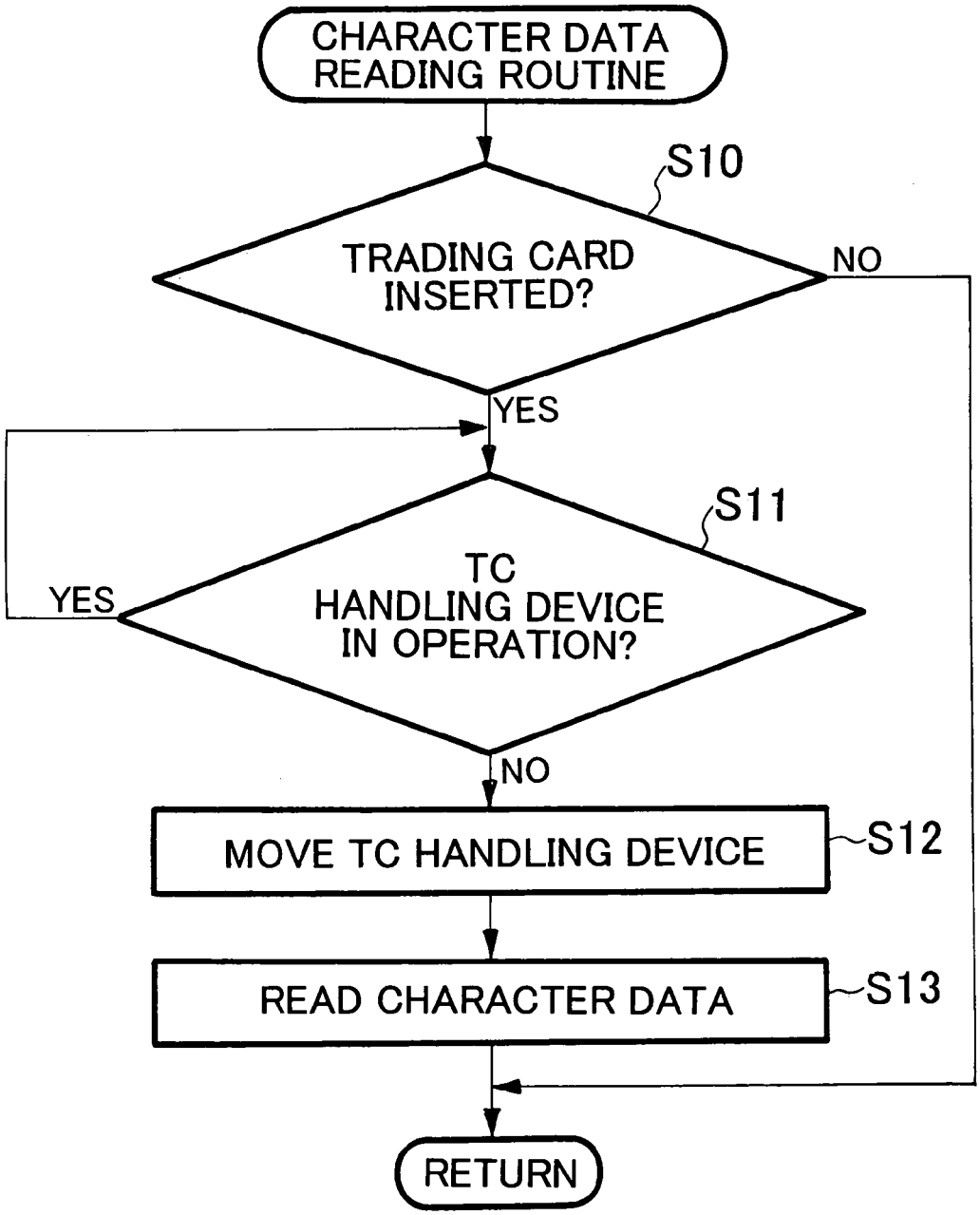
FIG. 6 is a flowchart showing a subroutine concerning a character data reading process executed in the satellite.

FIG. 6 is a flowchart showing a subroutine concerning the character data reading process executed in the satellite 12.

First, the CPU 41 determines whether a trading card is inserted in the TC slots 17 or not (step S10). Namely, the CPU 41 determines whether a detection signal from the sensor 64 is received or not.

If it is determined in step S10 that no trading card is inserted in the TC slots 17, this subroutine is terminated, and no character data will be read.

If it is determined in step S10 that the trading card is inserted in the TC slots 17, then the CPU 41 determines whether the TC handling device is in operation or not (step S11). Namely, the CPU 41 determines whether or not the TC handling device 60 is moving in order to read character data from other trading cards inserted in the TC slots 17 or whether or not the TC handling device 60 is reading character data from other trading cards.

When it is determined in step S11 that the TC handling device is in operation, the flow returns to step S11 so as to determine again whether the TC handling device is in operation or not. Namely, the processing of step S11 is repeatedly executed until the CPU 41 determines that the TC handling device is not in operation.

If it is determined in step S11 that the TC handling device is not in operation, then the CPU 41 moves the TC handling device 60 to a position where the trading card is mounted (step S12). Namely, by supplying a control signal to the running device 72, the CPU 41 actuates the running device 72, so as to move the TC handling device 60 along the rail 65 to the position where the trading card is mounted.

After the processing of step S12 is executed, the CPU 41 carries out processing for reading character data (step S13) Namely, by transmitting a control signal to the R/W 50, the CPU 41 causes the R/W 50 to transmit query radio waves to the trading card and receive answer radio waves emitted from the trading card, thereby terminating this subroutine. As a result, character data are read from the trading card inserted in the TC slots 17, and thus read character data are stored into the memory 42.

Since three TC slots 17 are provided, the gaming machine 10 in accordance with the present invention can read character data from three trading cards at the same time. Though not depicted, an image for promoting insertion of a trading card into the TC slots 17 may be displayed on the monitor 14 when it is determined in the processing of step S10 that no trading card is inserted in the TC slots 17, for example.

(C) Growth of Character

In the game provided by the gaming machine 10, the main character and other characters can improve their capacity values and the like by gaining experience through adventures, e.g., upon winning battles against monsters living in the virtual world or other players.

When the game ends, the trading card written with the character data read from the trading card (which may be referred to as "original character data" hereinafter) by the R/W 50 and character data changed according to the proceeding with the game (which may be referred to as "new character data" hereinafter) and newly printed with details of the new character data is issued.

A trading card rewriting process executed in the satellite 12 in response to the termination of the game will now be explained.

Figure 7:
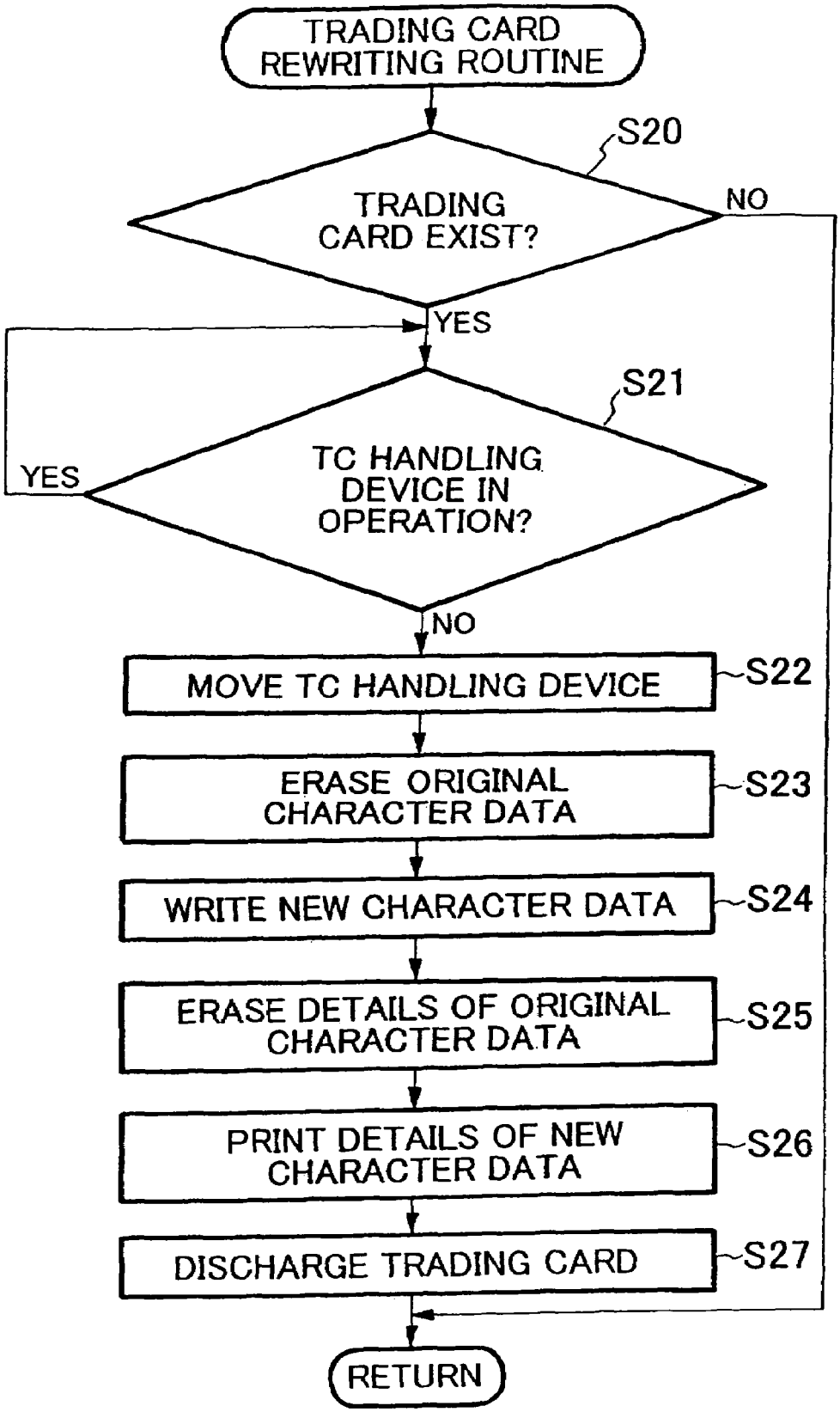
FIG. 7 is a flowchart showing a subroutine concerning a trading card rewriting process executed in the satellite.

FIG. 7 is a flowchart showing a subroutine concerning a trading card rewriting process executed in the satellite 12 when the game ends.

First, the CPU 41 determines whether the trading card exists or not (step S20). The processing in step S20 is carried out by determining whether the character data read in the processing of step S13 in the subroutine shown in FIG. 6 exists or not.

When it is determined in step S20 that no trading card exists, the subroutine is terminated since no trading card is inserted into the TC slot 17, whereby no trading card is rewritten.

When it is determined in step S20 that the trading card exists, the CPU 41 subsequently determines whether the TC handling device 60 is in operation or not (step S21). Namely, the CPU 41 determines whether or not the TC handling device 60 is moving in order to rewrite other trading cards mounted on the TC passage trough 61 or whether or not the TC handling device 60 is rewriting other trading cards.

When it is determined in step S21 that the TC handling device 60 is in operation, the flow returns to step S21 so as to determine again whether the TC handling device is in operation or not. Namely, the processing of step S21 is repeatedly executed until the CPU 41 determines that the TC handling device 60 is not in operation.

When it is determined in step S21 that the TC handling device 60 is not in operation, then the CPU 41 moves the TC handling device 60 to a position where the trading card is mounted (step S22). Namely, by supplying a control signal to the running device 72, the CPU 41 actuates the running device 72, so as to move the TC handling device 60 along the rail 65 to the position where the trading card is mounted.

When the processing of step S22 is executed, the CPU 41 transmits a control signal to the R/W 50, so as to erase the original character data stored in the trading card (step S23), and then carries out processing for writing and storing new character data into the trading card (step S24).

Here, the controller 40 and R/W 50 function as updating means for writing a changed character into the trading card in response to a change in character data.

When the processing of step S24 is executed, the CPU 41 transmits a control signal to the printing device 49, so as to erase details of the original character data printed on the trading card (step S25), and then prints details of new character data (step S26).

Here, the controller 40 and printing device 49 function as printing means for printing details of changed character data onto the surface of the trading card in response to a change in character data, and erasing means for erasing details of character data printed previously when the printing means prints details of the changed character data onto the surface of the trading card.

When the processing of step S26 is executed, then the CPU 41 transmits an instruction signal to the TC moving device 51, so as to issue the rewritten trading card (step S27), thereby terminating this subroutine. As a result, the player can obtain the trading card having new character data stored therein in connection with the original character data and details of new character data newly printed.

Figure 8:
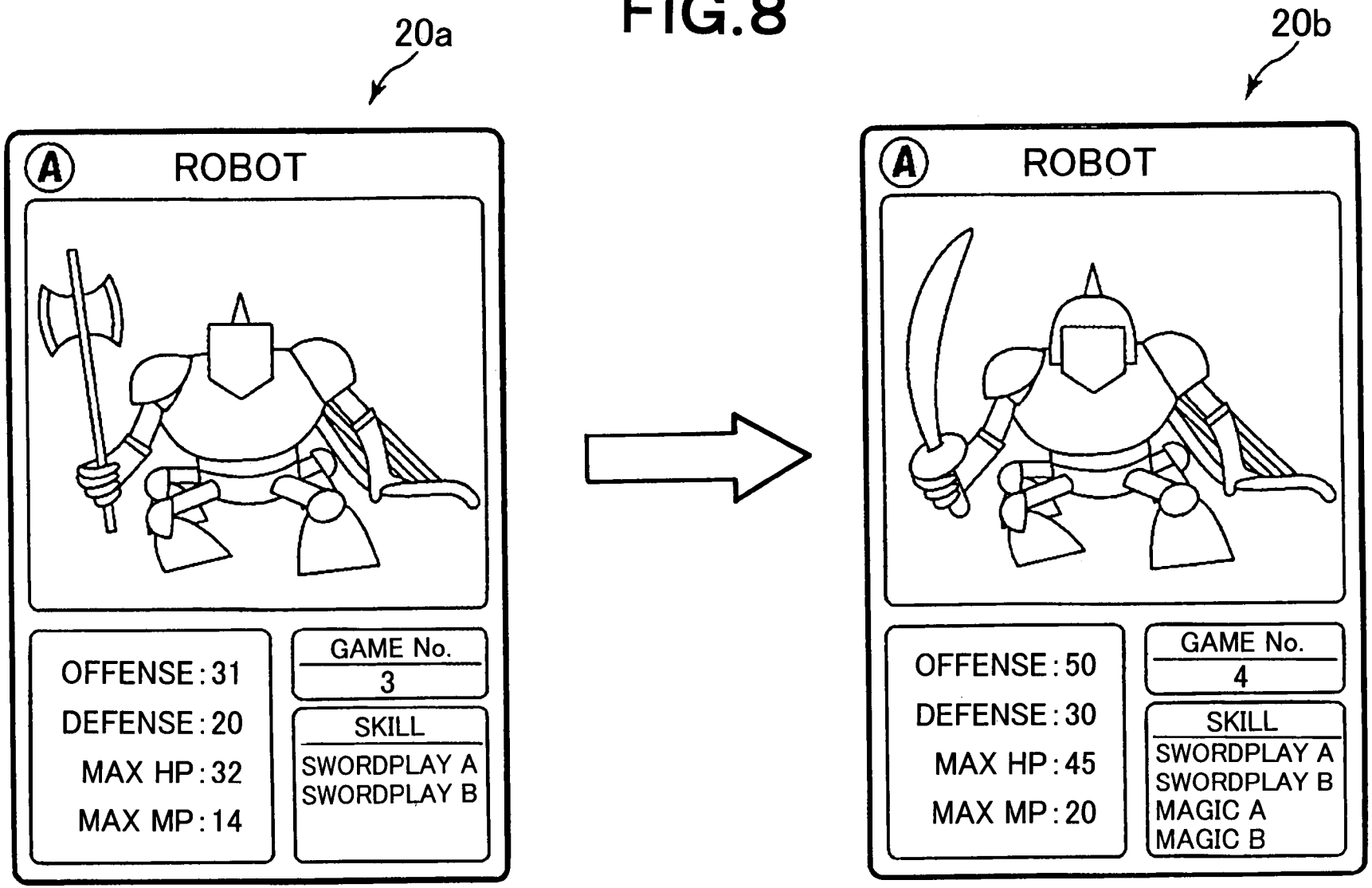
FIG. 8 is a view schematically showing an example of trading card printed with details of original character data and an example of trading card printed with details of new character data.

FIG. 8 is a view schematically showing an example of trading card printed with details of original character data and an example of trading card printed with details of new character data.

A trading card 20*a* is one printed with details of original character data, whereas a trading card 20*b* is one printed with details of new character data.

Values indicating offensive force, defensive force, maximum HP (physical power), and maximum MP (magical power), which are capacity values of new character data printed in the trading card 20*b*, are higher than those of original data printed in the trading card 20*a*. Also, skills (special capabilities) of the new character data printed in the trading card 20*b* include magic A and B in addition to swordplay A and B which are special capabilities of the original character data printed in the trading card 20*a*. The special capabilities are included in the capacity values. The figure of the character printed in the trading card 20*b* is one in which the figure of the character printed in the trading card 20*a* is partly changed. Specifically, the ax held by the character is replaced by a sword, and the character wears a helmet. Also, the number of games played with the trading card is changed from 3 to 4.

Since the capacity values and figure of the character changed according to the proceeding with the game and the number of games are printed onto the surface of the trading card as such, the player owning the trading card can grasp details of the character data stored in the trading card and changes thereof without depending on gaming machines.

As a result, the player can feel as if to grow the trading card, thereby becoming enthusiastic in the game.

Though the above-mentioned example relates to a case where, when the game ends, the trading card is rewritten and thus rewritten trading card is issued, the timing at which the trading card is rewritten is not restricted in particular in the present invention. For example, the trading card may be rewritten when the player requests the trading card to be issued.

Though the above-mentioned example relates to a case where details of character data are printed on the front face of the trading card, both sides of the trading card may be printed with details of the character data, for example, such that the figure of a character is printed on the front face of the trading card whereas capacity values and the like of the character are printed on the rear face.

Though the above-mentioned example relates to a case where one satellite is provided with one each of the R/W, heating device, and printing device, the numbers of R/Ws, heating devices, and printing devices provided in one satellite in the present invention are not restricted in particular. For example, the R/Ws, heating devices, and printing devices may be provided by the number identical to that of TC slots formed in the satellite.

Though the above-mentioned example relates to a case where one trading card printed with details of new character data is issued on the basis of one trading card printed with details of original character data, the number of trading cards used for the game in the present invention and the number of trading cards issued are not restricted in particular. For example, from two trading cards used in the game, one trading card inheriting their capacity values may be issued.

Though the above-mentioned example illustrates a case where all of the new character data, i.e., capacity values (offensive force, defensive force, physical power, magical power, and special capabilities) of the character, the figure of the character, and the number of games, are printed in the trading card, a part of details of the new character data (e.g., capacity value) may be printed in the trading card.

Preferably, as illustrated in the above-mentioned example, the present invention further comprises erasing means for erasing previously printed details of character data when printing details of new character data onto the surface of the trading card. This is because of the fact that details of character data printed on the surface of the trading card can be changed greatly, whereby the player can grasp details of the character data stored in the trading card or their changes more clearly. For example, the trading card shown in FIG. 8 changes the figure of the character in addition to capacity values thereof, whereby the player can grasp changes in the character data stored in the trading card.

In the present invention, without erasing details of previously printed character data, details of changed character data may be printed in addition thereto.

A case where details of changed character data are printed in addition will now be explained with reference to a drawing.

Figure 9:
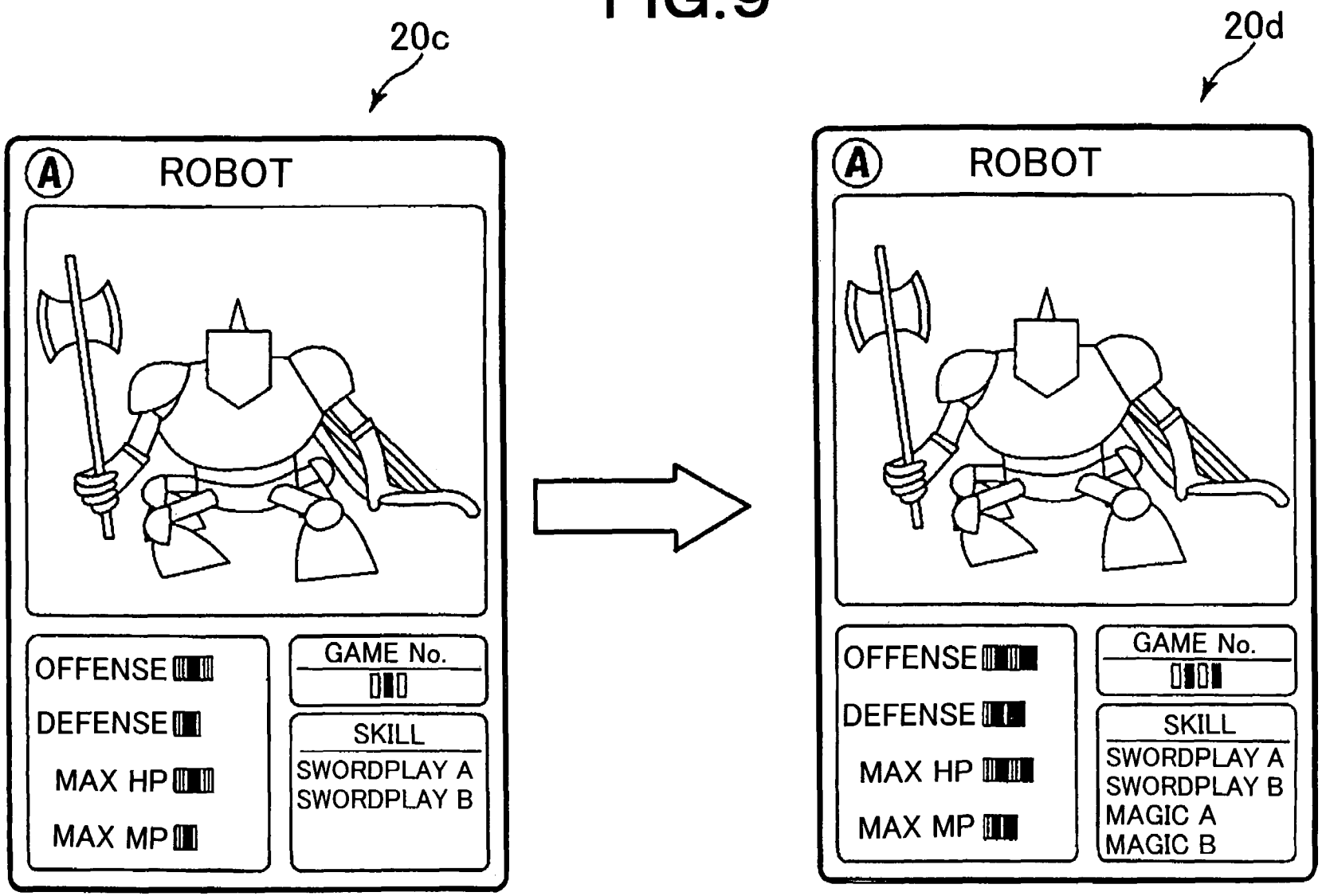
FIG. 9 is a view schematically showing another example of trading card printed with details of original character data and another example of trading card printed with details of new character data.

FIG. 9 is a view schematically showing another example of trading card printed with details of original character data and another example of trading card printed with details of new character data.

A trading card 20*c* is one printed with details of original character data, whereas a trading card 20*d* is one printed with details of new character data.

In each of the trading cards 20*c* and 20*d*, respective magnitudes of the offensive force, defensive force, physical power, and maximum power, which are capacity values of character data, and the number of games are represented by patterns simulating scales. The values indicated by the scales of the trading card 20*d* are greater than those in the trading card 20*c*. The special capabilities of new character data printed in the trading card 20*d* include magic A and B in addition to swordplay A and B which are special capabilities of original character data printed in the trading card 20*c*. This enables the player owning the trading card to grasp details of the character data stored in the trading card and changes thereof without depending on gaming machines.

In the gaming machine of the present invention, character data changed according to the proceeding with the game are stored in the trading card, and details of changed character data are printed on the surface of the trading card, whereby the player can grasp details of the character data stored in the trading card and changes thereof without depending on gaming machines.

Each time changed character data are stored in the trading card according to the proceeding with the game, the trading card of the present invention can erase and print details of the changed character data, whereby the player can grasp details of the character data stored in the trading card and changes thereof without depending on gaming machines.

In the game system of the present invention, character data changed according to the proceeding with the game are stored into the trading card, whereas details of changed character data are printed on the surface of the trading card, whereby the player can grasp details of the character data stored in the trading card and changes thereof without depending on gaming machines.

What is claimed is:

1. A gaming machine for providing a game played with a trading card with a semiconductor memory which stores character data of a character and a surface printed with a detail of the character data;

the gaming machine comprising:

a data updating device which writes changed character data into the semiconductor memory in the trading card in response to a change in the character data according to a state of proceeding with the game;

a printing device which prints a detail of the changed character data onto the surface of the trading card; and an erasing device which erases the detail of the character data printed previously when the printing device prints the detail of the changed character data onto the surface of the trading card.

2. A gaming machine according to claim 1, wherein, when printing the detail of the changed character data onto the surface of the trading card, the printing device is utilized so as to add the detail of the changed character data to the detail of the character data printed previously.

3. A gaming machine according to claim 1, further comprising a trading card moving device having a slot which inserts and discharges the trading card, the trading card moving device moving the trading card inserted in the slot into the gaming machine.

4. A gaming machine according to claim 1, wherein said semiconductor memory in the trading card comprises a flash memory.

5. A plurality of gaming machines arranged in parallel, wherein at least one of the gaming machines comprises:

a data updating device which writes changed character data into a semiconductor memory in a trading card in response to a change in the character data according to a state of proceeding with a game;

a printing device which prints a detail of the changed character data onto the surface of the trading card; and an erasing device which erases the detail of the character data printed previously when the printing device prints the detail of the changed character data onto the surface of the trading card.

6. A game system comprising:

a trading card with a semiconductor memory which stores character data of a character and has a surface printed with a detail of the character data;

a game controlling device which proceeds with a game according to the character data stored in the trading card with the semiconductor memory and a control signal from a controller;

a data updating device which writes changed character data in the trading card with the semiconductor memory in response to a change in the character data according to a state of proceeding with the game;

a printing device which prints a detail of the changed character data on to the surface of the trading card; and an erasing device which erases the detail of the character data printed previously when the printing device prints the detail of the changed character data onto the surface of the trading card.

7. A game system according to claim 6, wherein, when printing the detail of the changed character data onto the surface of the trading card, the printing device is utilized so as to add the detail of the changed character data to the detail of the character data printed previously.

8. A game system according to claim 6, further comprising a trading card moving device having a slot which inserts and discharges the trading card, the trading card moving device moving the trading card inserted in the slot into the game system.

9. A gaming machine according to claim 6, wherein said semiconductor memory in the trading card comprises a flash memory.

10. A plurality of game systems arranged in parallel, wherein at least one of the game systems comprises:

a trading card with a semiconductor memory which stores character data of a character and a surface printed with a detail of the character data;

a game controlling device which proceeds with a game according to the character data stored in the trading card with the semiconductor memory and a control signal from a controller;

a data updating device which writes changed character data in the trading card with the semiconductor memory in response to a change in the character data according to a state of proceeding with the game;

a printing device which prints a detail of the changed character data onto the surface of the trading card; and an erasing device which erases the detail of the character data printed previously when the printing device prints the detail of the changed character data onto the surface of the trading card.

11. A plurality of game systems in accordance with claim 10, wherein said semiconductor memory in the trading card comprises a flash memory.

12. A gaming machine for providing a game played with a trading card with a semiconductor memory which stores character data of a character and a surface printed with a detail of the character data;

the gaming machine comprising:

updating means for writing changed character data in the trading card with the semiconductor memory in response to a change in the character data according to a state of proceeding with the game;

printing means for printing a detail of the changed character data on to the surface of the trading card; and erasing means for erasing the detail of the character data printed previously when the printing means prints the detail of the changed character data onto the surface of the trading card.

13. A gaming machine according to claim 12, wherein said semiconductor memory in the trading card comprises a flash memory.

14. A game system comprising:

a trading card with a semiconductor memory which stores character data of a character and has a surface printed with a detail of the character data;

game controlling means for proceeding with a game according to the character data stored in the trading card with the semiconductor memory and a control signal from a controller;

updating means for writing changed character data in the trading card with the semiconductor memory in response to a change in the character data according to a state of proceeding with the game;

printing means for printing a detail of the changed character data onto the surface of the trading card; and erasing means for erasing the detail of the character data printed previously when the printing means prints the detail of the changed character data onto the surface of the trading card.

15. A gaming machine according to claim 14, wherein said semiconductor memory in the trading card comprises a flash memory.

* * * * *